US009580658B2

(12) United States Patent
Kuznetsov et al.

(10) Patent No.: US 9,580,658 B2
(45) Date of Patent: Feb. 28, 2017

(54) METHODS OF OBTAINING A HYDROCARBON MATERIAL FROM A MINED MATERIAL, AND RELATED STABILIZED EMULSIONS

(71) Applicant: Baker Hughes Incorporated, Houston, TX (US)

(72) Inventors: Oleksandr V. Kuznetsov, Sugar Land, TX (US); Gaurav Agrawal, Aurora, CO (US); Valery N. Khabashesku, Houston, TX (US); Devesh K. Agrawal, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 249 days.

(21) Appl. No.: 14/289,838

(22) Filed: May 29, 2014

(65) Prior Publication Data

US 2015/0344786 A1 Dec. 3, 2015

(51) Int. Cl.

| | |
|---|---|
| ***C10G 1/04*** | (2006.01) |
| ***C10G 33/04*** | (2006.01) |
| ***C10G 1/08*** | (2006.01) |
| *C10G 1/00* | (2006.01) |

(52) U.S. Cl.

CPC ..... *C10G 1/045* (2013.01); *C10G 1/047* (2013.01); *C10G 1/086* (2013.01); *C10G 33/04* (2013.01); *C10G 2300/208* (2013.01)

(58) Field of Classification Search

CPC ..... C10G 1/00; C10G 1/04; C10G 1/045

See application file for complete search history.

(56) References Cited

U.S. PATENT DOCUMENTS

| | | | | |
|---|---|---|---|---|
| 5,169,518 | A | 12/1992 | Klimpel | |
| 6,007,709 | A | 12/1999 | Duyvesteyn et al. | |
| 6,214,213 | B1 | 4/2001 | Tipman et al. | |
| 7,093,499 | B2 | 8/2006 | Baudendistel | |
| 7,357,857 | B2 | 4/2008 | Hart et al. | |
| 8,114,274 | B2 | 2/2012 | Moran et al. | |
| 8,343,337 | B2 | 1/2013 | Moffett et al. | |
| 8,663,462 | B2 | 3/2014 | Duyvesteyn | |
| 2001/0049902 | A1* | 12/2001 | Varadaraj | C09K 8/36 44/301 |
| 2010/0193403 | A1* | 8/2010 | Yeggy | C10G 1/04 208/390 |
| 2012/0318718 | A1 | 12/2012 | Simpson et al. | |
| 2013/0320467 | A1 | 12/2013 | Buchanan et al. | |

FOREIGN PATENT DOCUMENTS

| | | |
|---|---|---|
| CA | 2030934 A1 | 5/1992 |

OTHER PUBLICATIONS

Laskowski, J. et al. (1969). Journal of Colloid and Interface Science, 29(4) 670-679 [reference in Office action is made to abstract only].*

* cited by examiner

*Primary Examiner* — Brian McCaig
(74) *Attorney, Agent, or Firm* — TraskBritt

(57) ABSTRACT

A method of obtaining a hydrocarbon material from a mined material comprises forming a colloidal dispersion comprising solid particles and a carrier fluid. The colloidal dispersion is mixed with a mined, hydrocarbon-containing material to form an emulsion stabilized by the solid particles. At least one property of the emulsion is modified to destabilize the emulsion. Additional methods of obtaining a hydrocarbon material from a mined material, and a stabilized emulsion are also described.

19 Claims, 1 Drawing Sheet

METHODS OF OBTAINING A HYDROCARBON MATERIAL FROM A MINED MATERIAL, AND RELATED STABILIZED EMULSIONS

TECHNICAL FIELD

Embodiments of the disclosure relate generally to methods of obtaining a hydrocarbon material from a mined material, and to related stabilized emulsions. More particularly, embodiments of the disclosure relate to methods of obtaining a hydrocarbon material from a mined material using a colloidal dispersion including solid particles and a carrier fluid, and to stabilized emulsions including the solid particles.

BACKGROUND

Naturally occurring bitumen-containing materials such as tar sands, oil sands, bituminous sands, black shales, coal formations, and weathered hydrocarbon formations contained in sandstones and carbonates have become an attractive source of hydrocarbon recovery. Bitumen is a heavy type of crude oil that can be processed (e.g., cracked) to yield lighter hydrocarbons and other commercially useful products. Naturally occurring bitumen-containing materials typically include bitumen, water, and various mineral solids (e.g., organic solids such as coal, and/or inorganic solids such as sand, rock, silt, and clay). Accordingly, an initial step in obtaining lighter hydrocarbons and other commercially useful products from bitumen includes removing (e.g., extracting, separating, etc.) the bitumen from a naturally occurring bitumen-containing material.

An example of a conventional process for obtaining bitumen from a bitumen-containing material includes mining the bitumen-containing material, mixing the mined material with hot water and caustic to produce a slurry, screening the slurry to remove larger solid materials, diluting the screened slurry with additional hot water, and temporarily retaining the diluted slurry in a primary separation vessel ("PSV"). In the PSV, bitumen globules contact and coat air bubbles that are introduced into and/or are already entrained within the diluted slurry. The buoyant bitumen-bubble aggregates rise through the diluted slurry, along with some mineral-bubble aggregates, and form a primary bitumen froth in a top section of the PSV. Middlings comprising water and neutrally buoyant bitumen-mineral-bubble aggregates collect in a middle section of the PSV. Mineral solids not suspended within the primary bitumen froth or the middlings settle in a bottom section of the PSV. The middlings are withdrawn and treated in a series of sub-aerated, impeller-agitated floatation cells to produce a secondary bitumen froth. The primary and secondary bitumen froths are treated with solvents (e.g., naptha) and subjected to additional separation processes (e.g., centrifuging) to remove the bitumen from remaining water and mineral solids. The removed bitumen is then subjected to additional refining to produce lighter hydrocarbons and other commercially useful products. Tailings including the water and mineral solids separated during the extraction process, together with some bitumen, are sent to at least one tailings pond for long-term storage and treatment.

Unfortunately, conventional processes for obtaining bitumen from a bitumen-containing material can suffer from a variety of problems. For example, conventional processes may result in a high concentration of suspended mineral solid particles in the primary bitumen froth, middlings, and secondary bitumen froth, which can require complex, inefficient, and cost-prohibitive methods and systems to be substantially removed. In addition, the tailings produced by conventional methods may include significant amounts of bitumen, representing lost bitumen yield. Furthermore, the tailings may exhibit a sludge-like consistency that can essentially last indefinitely, and may also include hazardous materials (e.g., extraction solvents), necessitating the use of specialized and costly tailings ponds for long-term storage and treatment.

Thus, there remains a need for new, simple, and cost-efficient methods of obtaining bitumen from bitumen-containing materials that overcome one or more of the above problems.

BRIEF SUMMARY

Embodiments described herein include methods of obtaining a hydrocarbon material from a mined material, as well as related stabilized emulsions. For example, in accordance with one embodiment described herein, a method of obtaining a hydrocarbon material from a mined material comprises forming a colloidal dispersion comprising solid particles and a carrier fluid. The colloidal dispersion is mixed with a mined, hydrocarbon-containing material to form an emulsion stabilized by the solid particles. At least one property of the emulsion is modified to destabilize the emulsion.

In additional embodiments, a method of obtaining a hydrocarbon material from a mined material comprises forming nanoparticles comprising at least one of a metal oxide, a carbide, and a nitride. The nanoparticles are combined with an aqueous material to form a colloidal dispersion. The colloidal dispersion is mixed with a mined material containing a hydrocarbon material to separate the hydrocarbon material from other components of the mined material and form an emulsion stabilized by the nanoparticles. At least one of a pH, a material composition, and a temperature of the emulsion is modified to destabilize the emulation and coalesce the hydrocarbon material.

In further embodiments, a stabilized emulsion comprises a dispersed phase comprising bitumen, a continuous phase comprising an aqueous material, and silica nanoparticles gathered at interfaces of the dispersed phase and the continuous phase.

DETAILED DESCRIPTION

Figure 1:
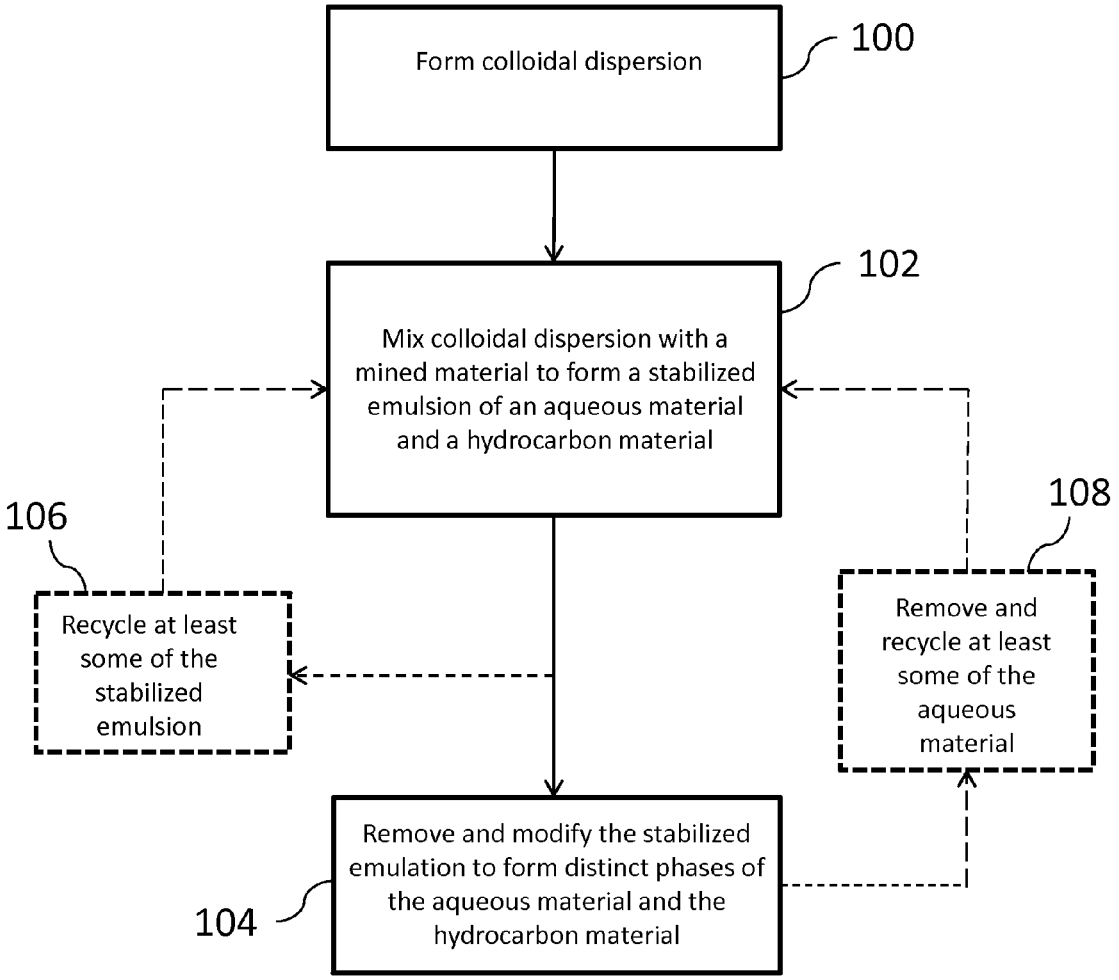
FIG. 1 is a simplified flow diagram depicting a method of obtaining a hydrocarbon material from a mined material, in accordance with embodiments of the disclosure.

Methods of obtaining a hydrocarbon material (e.g., bitumen) from a mined material (e.g., tar sand, oil sand, bituminous sand, black shale, a coal formation, a weathered hydrocarbon formation contained in sandstone and/or carbonate, etc.) are described, as are related stabilized emulsions of a hydrocarbon material and an aqueous material. In some embodiments, a method of obtaining a hydrocarbon material from a mined material includes forming a colloidal dispersion formed of and including solid particles and a carrier fluid. The solid particles may be structured and formulated to remove (e.g., detach) the hydrocarbon material from a solid material (e.g., mineral solids, such as coal, sand, rock, silt, clay, etc.) of the mined material. In addition, the solid particles may be structured and formulated to gather at, adhere to, and/or adsorb to interfaces of the hydrocarbon material and an aqueous material to form a stabilized emulsion (e.g., a Pickering emulsion) comprising units of one of the hydrocarbon material and the aqueous material dispersed in the other of the hydrocarbon material and the aqueous material. The stabilized emulsion may be separated from at least a portion of the solid material of the mined material, and then at least one property (e.g., pH, material composition, temperature, etc.) of the stabilized emulsion may be modified to coalesce the hydrocarbon material and the aqueous material of the stabilized emulsion into distinct, immiscible phases. The hydrocarbon material may then be separated from the aqueous material and utilized as desired. The methods of the disclosure may increase the simplicity and efficiency, and reduce the costs of obtaining (e.g., extracting, separating, etc.) a hydrocarbon material from a mined material as compared to conventional methods.

The following description provides specific details, such as specific material compositions and specific processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow for recovering a hydrocarbon material from a mined material. Only those process acts and structures necessary to understand the embodiments of the disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the disclosure.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and accompanying drawings and does not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

FIG. 1 is a simplified flow diagram illustrating a method of obtaining a hydrocarbon material (e.g., bitumen) from a mined material (e.g., tar sand, oil sand, bituminous sand, black shale, a coal formation, a weathered hydrocarbon formation contained in sandstone and/or carbonate, etc.), in accordance embodiments of the disclosure. The method may include a dispersion formation process 100 including forming a colloidal dispersion formed of and including a solid particles and a carrier fluid; an extraction process 102 including mixing the colloidal dispersion with a mined material to remove a hydrocarbon material from other components (e.g., mineral solids) of the mined material and form a stabilized emulsion of the hydrocarbon material and an aqueous material; and a destabilization process 104 including removing and modifying the stabilized emulsion to coalesce the hydrocarbon material and the aqueous material into distinct, immiscible phases. Optionally, the method may also include at least one of a hydrocarbon enrichment process 106 including recycling at least a portion of the stabilized emulsion prior to the destabilization process 104 to form an additional stabilized emulsion having an increased concentration of hydrocarbon material; and an aqueous phase recycle process 108 including recycling at least a portion of the aqueous material recovered from the destabilization process 104 to assist with the formation of an additional stabilized emulsion. With the description as provided below, it will be readily apparent to one of ordinary skill in the art that the method described herein may be used in various applications. In other words, the method may be used whenever it is desired to obtain a hydrocarbon material from a composite material including the hydrocarbon material and at least other material (e.g., at least one solid material, such as one or more of an organic solid material and an inorganic solid material).

Referring to FIG. 1, the dispersion formation process 100 includes forming a colloidal dispersion formed of and including solid particles and a carrier fluid. The solid particles are dispersed and suspended within the carrier fluid. The solid particles are compatible with the other components (e.g., materials, constituents, etc.) of the colloidal dispersion. As used herein, the term "compatible" means that a material does not react, decompose, or absorb another material in an unintended way, and also that the material does not impair the chemical and/or mechanical properties of the another material in an unintended way. For example, each of the solid particles may be structured (e.g., sized, shaped, layered, etc.) and formulated such that the solid particles do not substantially react with another material (e.g., an aqueous material, a hydrocarbon material, etc.) under the conditions (e.g., pH, temperature, pressure, flow rate, material exposure, etc.) in which the solid particles are mixed with a mined material.

The solid particles are structured and formulated to facilitate the formation of a stabilized emulsion of a hydrocarbon material and an aqueous material, and are also structured and formulated to facilitate the subsequent destabilization of the stabilized emulsion. For example, the solid particles may be structured and formulated to gather (e.g., agglomerate) at, adhere to, and/or adsorb to interfaces of a hydrocarbon material and an aqueous material under predetermined environmental conditions (e.g., pH, temperature, material exposure, etc.) to form a Pickering emulsion comprising units (e.g., droplets) of one of the hydrocarbon material and the aqueous material dispersed in the other of the hydrocarbon material and an aqueous material. The solid particles may prevent the dispersed material (e.g., the hydrocarbon material, or the aqueous material) from coalescing, and may thus maintain the dispersed material as units throughout the other material. In turn, modifying one or more of the properties (e.g., pH, temperature, material composition, etc.) of the stabilized emulsion may disperse, detach, and/or desorb the solid particles from the interfaces of the hydrocarbon material and the aqueous material to coalesce the hydrocarbon material and the aqueous material into distinct, immiscible phases. At least a portion of the solid particles may, for example, agglomerate at, adhere to, and/or adsorb to interfaces of a hydrocarbon material and an aqueous material at a first temperature and/or a first pH, but may disperse from, detach from, and/or desorb from interfaces of a hydrocarbon material and an aqueous material at second, higher temperature and/or a second, lower pH.

In addition, the solid particles may be structured and formulated to remove (e.g., detach) a hydrocarbon material from surfaces of a mined material. For example, at least a portion of the solid particles may be structured and formulated to be at least partially abrasive. As used herein, the term "abrasive" means that a structure (e.g., particle) is able to mar, scratch, scrape, gouge, abrade, and/or shear a material from a surface. The solid particles may, for example, be structured and formulated to remove the hydrocarbon material from solid surfaces of the mined material upon contacting an interface of the hydrocarbon material and a solid material of the mined material.

As a non-limiting example, at least a portion of the solid particles may be formed of and include a metal oxide, such as at least one of silica, alumina, titania, ceria, zirconia, germania, magnesia, an iron oxide, and zinc oxide. As another non-limiting example, at least a portion of the solid particles may be formed of and include one or more carbides, such as silicon carbide. As a further non-limiting example, at least a portion of the solid particles may be formed of and include one or more nitrides, such as silicon nitride. In some embodiments, at least a portion of the solid particles are formed of and include silica. In additional embodiments, at least a portion of the solid particles are formed of and include alumina.

At least some of the solid particles may comprise composite particles. As used herein, the term "composite particle" means and includes a particle including at least two constituent materials that remain distinct on a micrometric level while forming a single particle. For example, the composite particle may include a core of a first material at least partially encapsulated (e.g., covered, surrounded, etc.) by a shell of a second material. As a non-limiting example, at least a portion of the solid particles may be formed of and include at least one shell of a metal oxide (e.g., silica, alumina, titania, ceria, zirconia, germania, magnesia, an iron oxide, zinc oxide, etc.), a metal carbide (e.g., silicon carbide), and a metal nitride (e.g., silicon nitride) at least partially surrounding a core formed of and including at least one other material (e.g., a polymer material, a crystalline material, an organic material, an inorganic material, a metallic material, a magnetic material, a ceramic material, etc.). The shell may be attached to the core through at least one of chemical bonds with atoms of the core, ion-dipole interactions, x-cation and x-n interactions, and surface adsorption (e.g., chemisorption, and/or physisorption).

At least some of the solid particles may be functionalized to limit and/or enhance interactions between the solid particles and different components of a mined material. For example, the solid particles may be configured to exhibit an affinity for at least one material provided to and/or already present within the mined material. Such an affinity may assist with the dispersion of the solid particles within a carrier fluid (e.g., an aqueous material) of the colloidal dispersion, may assist in the removal of a hydrocarbon material from surfaces (e.g., solid surfaces, liquid surfaces) of the mined material, and/or may assist in the stabilization of mixtures (e.g., emulsions, such as hydrocarbon material dispersed in aqueous material emulsions, or aqueous material dispersed in hydrocarbon material emulsions) formed from at least a portion of the mined material. The solid particles may be structured and formulated (e.g., through one or more functional groups) to be at least partially hydrophilic, amphiphilic, oxophilic, lipophilic, and/or oleophilic. As a non-limiting example, hydrophilic functional groups may enable the solid particles too more readily stabilize hydrocarbon-water and/or hydrocarbon-brine emulsions in which the continuous phase is water or brine. In some embodiments, the solid particles are structured and formulated to exhibit an affinity for both a solid surface of the mined material and a hydrocarbon material present within the mined material. Such an affinity may, for example, enable the solid particles to gather (e.g., agglomerate) at an interface between the solid surface of the mined material and the hydrocarbon material to assist with removing the hydrocarbon material from the solid surface of the mined material. Any portions (e.g., cores, shells, etc.) of the solid particles may be functionalized to exhibit desired affinities and/or aversions for different materials.

Non-limiting examples of suitable functional groups for modifying the affinities and/or aversions of the solid particles for different materials include carboxy groups; epoxy groups; ether groups; ketone groups; amine groups; hydroxy groups; alkoxy groups; alkyl groups, such as methyl, ethyl, propyl, butyl, pentyl, hexyl, octyl, dodecyl, and/or octadecyl groups; aryl groups, such as phenyl, and/or hydroxyphenyl groups; aralkyl groups; alkaryl groups, such as benzyl groups attached via the aryl portion (e.g., 4-methylphenyl, 4-hydroxymethylphenyl, or 4-(2-hydroxyethyl)phenyl, and/or aralkyl groups attached at the benzylic (alkyl) position, such as in a phenylmethyl and 4-hydroxyphenylmethyl groups, and/or attached at the 2-position, such as in a phenethyl and 4-hydroxyphenethyl groups); lactone groups; functionalized polymeric groups, such as acrylic chains having carboxylic acid groups, hydroxyl groups, and/or amine groups; functionalized oligomeric groups; and/or combinations thereof. The functional groups may be attached to the solid particles directly, and/or through intermediate functional groups (e.g., carboxy groups, amino groups, etc.) by way of one or more conventional reaction mechanisms (e.g., amination, nucleophilic substitution, oxidation, Stille coupling, Suzuki coupling, diazo coupling, organometallic coupling, etc.). In further embodiments, at least some of the solid particles are formulated to exhibit desired affinities and/or aversions for different materials without having to perform additional processing acts to attach functional groups thereto. For example, one or more portions (e.g., shells, cores, etc.) of at least some of the solid particles may already exhibit desired affinities and/or aversions for different materials without having to perform additional functionalization acts.

Each of the solid particles may have substantially the same surface modification (e.g., shell, surface functionalization, combination thereof, etc.), the surface modification of at least one of the solid particles may be different than the surface modification of at least one other of the solid particles, or at least one of the solid particles may have substantially no surface modification. In some embodiments, each of the solid particles is substantially free of surface modifications. In additional embodiments, each of the solid particles has substantially the same surface modification. In further embodiments, a portion of the solid particles have substantially the same surface modification, and another portion of the solid particles have a different surface modification. In yet further embodiments, a portion of the solid particles have at least one type of surface modification, and another portion of the solid particles are substantially free of surface modifications.

The size and shape of each of the solid particles may be selected to facilitate the formation of a colloidal dispersion, and may also be selected based on the characteristics of the mined material. For example, the solid particles may be sized and shaped based on one or more properties (e.g., molecular weight, density, viscosity, etc.) of a hydrocarbon material (e.g., bitumen) contained within the interstitial spaces of the mined material. Relatively smaller particles may, for example, be selected to increase the stability of an emulsion including an aqueous material (e.g., an aqueous alkaline material) and a hydrocarbon material from the mined material. In some embodiments, the solid particles may comprise solid nanoparticles. As used herein, the term "nanoparticle" means and includes a particle having an average particle width or diameter of less than about 1 micrometer (μm) (i.e., 1000 nanometers). Each of the solid particles may, for example, independently have an average particle width or diameter of less than or equal to about 500 nm, less than or equal to about 250 nm, or less than or equal to about 100 nm. In some embodiments, each of the solid particles independently has an average particle width or diameter of within a range of from about 1 nm to about 100 nm. In additional embodiments, one or more of the solid particles may have an average particle width or diameter greater than or equal to about 1 μm, such as within a range of from about 1 μm to about 25 μm, from about 1 μm to about 20 μm, or from about 1 μm to about 10 μm. Furthermore, each of the solid particles may independently exhibit a desired shape, such as a spherical shape, a hexahedral shape, an ellipsoidal shape, a cylindrical shape, a conical shape, or an irregular shape. In some embodiments, each of the solid particles has a substantially spherical shape.

The solid particles may be monodisperse, wherein each of the solid particles exhibits substantially the same size, shape, and material composition, or may be polydisperse, wherein the solid particles include a range of sizes, shapes, and/or material compositions. In some embodiments, each of the solid particles comprises an silica nanoparticle having substantially the same size and the same shape as each other of the solid particles. In additional embodiments, each of the solid particles comprises a core of a first material (e.g., a polymer material, a crystalline material, an organic material, an inorganic material, a metallic material, a magnetic material, a ceramic material, etc.) covered with a shell of a second material (e.g., a metal oxide, such as silica, alumina, titania, ceria, zirconia, germania, magnesia, an iron oxide, zinc oxide; a metal carbide, such as silicon carbide; a metal nitride, such as silicon nitride; etc.), and has substantially the same size and the same shape as each other of the solid particles. In further embodiments, at least one of the solid particles comprises a different size, a different shape, and/or a different material composition than at least one other of the solid particles.

The concentration of the solid particles in the colloidal dispersion may be tailored to the amount and material composition of the hydrocarbon material contained within the mined material. The colloidal dispersion may include a sufficient amount of the solid particles to facilitate the removal (e.g., detachment) of the hydrocarbon material from surfaces of the mined material. In addition, the colloidal dispersion may include a sufficient amount of the solid particles to facilitate the formation of a stabilized emulsion (e.g., a Pickering emulsion) of the hydrocarbon material and an aqueous material. By way of non-limiting example, the colloidal dispersion may comprise greater than or equal to about 0.1 percent by weight (wt %) solid particles, such as from about 0.1 wt % to about 10 wt % solid particles, from about 0.1 wt % to about 5 wt % solid particles, or from about 0.1 wt % to about 1.0 wt % solid particles.

The carrier fluid of the colloidal dispersion may comprise any flowable material that is compatible with the solid particles of the colloidal dispersion, and that facilitates the formation of a stabilized emulsion when the colloidal dispersion is mixed with a mined material. The carrier fluid may, for example, comprise an aqueous material, such as an aqueous alkaline material. In some embodiments, the carrier fluid is an aqueous alkaline solution comprising water and at least one of sodium hydroxide (NaOH), potassium hydroxide (KOH), lithium hydroxide (LiOH), sodium carbonate ($Na_2CO_3$), potassium carbonate ($K_2CO_3$), lithium carbonate ($Li_2CO_3$), ammonia ($NH_4$), and methyl amine ($CH_5N$).

In addition, the colloidal dispersion may, optionally, include at least one additive. By way of non-limiting example, the additive may be at least one of a surfactant, a dispersant, a scale inhibitor, a scale dissolver, a defoamer, a biocide, and/or a different additive. The type and amount of the additive may at least partially depend on the properties of the solid particles, on the properties of the mined material, and on the properties of the hydrocarbon material contained within the mined material. The colloidal dispersion may be substantially homogeneous (e.g., the solid particles and the additive, if present, may be uniformly dispersed throughout the colloidal dispersion), or may be heterogeneous (e.g., the solid particles and the additive, if present, may be non-uniformly dispersed throughout the colloidal dispersion).

With continued reference to FIG. 1, the extraction process 102 includes mixing (e.g., combining and agitating) the colloidal dispersion with a mined material containing a hydrocarbon material (e.g., bitumen). The mined material may, for example, comprise at least one of tar sand, oil sand, bituminous sand, black shale, a coal formation, and a weathered hydrocarbon formation contained in sandstone and/or carbonate. In some embodiments, the mined material comprises oil-wetted grains of solid material (e.g., mineral solids, such as coal, sand, rock, silt, clay, etc.), such as the oil-wetted grains of sand present in the tar sands of Utah. In additional embodiments, the mined material comprises water-wetted grains of solid material (e.g., mineral solids, such as coal, sand, rock, silt, clay, etc.), such as the water-wetted sand grains present in the tar sands of Canada. The mined material may be removed from an earthen formation and transported for further processing using conventional processes and equipment, which are not described in detail herein. In addition, the mined material may be treated (e.g., crushed; combined with another material, such as an aqueous material; sifted; etc.) prior to being mixed with the colloidal dispersion using additional conventional processes and equipment, which are also not described in detail herein.

As the colloidal dispersion is mixed with the mined material, the solid particles of the colloidal dispersion may remove (e.g., detach) at least a portion of the hydrocarbon material contained within the mined material. In addition, the solid particles may gather (e.g., agglomerate) at, adhere to, and/or adsorb to interfaces of the hydrocarbon material and an aqueous material (e.g., an aqueous material derived from the carrier fluid of the colloidal dispersion; and an aqueous component already associated with the mined material, if any) to form a stabilized emulsion (e.g., a Pickering emulsion) comprising units (e.g., droplets) of one of the hydrocarbon material and the aqueous material dispersed in the other of the hydrocarbon material and an aqueous material. In some embodiments, the stabilized emulsion comprises units of the hydrocarbon material dispersed in an aqueous material. The solid particles may prevent the dispersed material (e.g., the hydrocarbon material, or the aqueous material) from coalescing, and may thus maintain the dispersed material as units throughout the other material. In additional embodiments, the emulsion may be further stabilized using a surfactant. The colloidal dispersion may be mixed with the mined material using at least one of a continuous process and a batch process. At least a portion of the solid material (e.g., mineral solids) of the mined material may separate from the stabilized emulsion and settle during and/or after the formation of the stabilized emulsion.

The colloidal dispersion and the mined material may be mixed together at any agitation rate facilitating the formation of the stabilized emulsion. In some embodiments, the colloidal dispersion and the mined material are mixed at an agitation rate (e.g., shear rate) that is lower than an agitation rate conventionally associated with extracting bitumen from tar sands (e.g., through a conventional floatation process). As compared to many conventional processes, the relatively lower agitation rate may decrease the amount of solid material (e.g., sand particles, rock particles, silt particles, clay particles, etc.) of the mined material that remains mixed with the hydrocarbon material during the extraction of the hydrocarbon material.

Next, in the destabilization process 104, the stabilized emulation may be removed from the settled solid material and destabilized to coalesce the hydrocarbon material and the aqueous material into distinct, immiscible phases. The coalesced aqueous material may include at least a portion (e.g., a majority, substantially all, etc.) of the solid particles located at interfaces of the stabilized emulation. To destabilize the stabilized emulsion at least one property (e.g., pH, material composition, temperature, pressure, etc.) of the stabilized emulsion may be modified (e.g., altered, changed) to disperse, detach, and/or desorb the solid particles from the interfaces of the hydrocarbon material and the aqueous material. As a non-limiting example, the pH of the stabilized emulsion may be decreased to destabilize the stabilized emulsion. For example, the stabilized emulsion may be exposed to (e.g., contacted with) to a material having a pH less than the pH of the stabilized emulsion, such as least one of hydrochloric acid (HCl), hydrobromic acid (HB), nitric acid ($HNO_3$), sulfuric acid ($H_2SO_4$), phosphoric acid ($H_3PO_4$), formic acid ($CH_2O_2$), and acetic acid ($C_2H_4O_2$). As another non-limiting example, the stabilized emulsion may be combined with at least one demulsifying agent to destabilize the stabilized emulsion. For example, at least one of toluene, an alkylphenol formaldehyde resin alkoxylate, a polyalkylene glycol, an organic sulfonate, and an aliphatic compound may be added to the stabilized emulsion. As a further non-limiting example, the temperature of the stabilized emulsion may be modified (e.g., decreased) to destabilize the stabilized emulsion.

Optionally, at least a portion of the stabilized emulsion may be utilized in the hydrocarbon enrichment process 106 prior to being subjected to the destabilization process 104. For example, as shown in FIG. 1, at least a portion of the stabilized emulsion may be recycled and combined with (e.g., added to) additional mined material to form an additional stabilized emulsion exhibiting an increased amount of hydrocarbon material as compared to the stabilized emulsion. The additional stabilized emulsion may then be destabilized to coalesce the hydrocarbon material and the aqueous material thereof into distinct, immiscible phases, in a manner substantially similar to that previously described with respect to destabilizing the stabilized emulsion.

After coalescing the hydrocarbon material and the aqueous material into distinct, immiscible phases one or more processes may be utilized to remove (e.g., separate, recover, collect, etc.) the coalesced hydrocarbon material (e.g., hydrocarbon material phase) from the coalesced aqueous material (e.g., aqueous material phase). The removed hydrocarbon material and the removed aqueous material may then be further processed, utilized, and/or disposed of as desired. In some embodiments, at least a portion of the removed hydrocarbon material may be subjected to one or more additional processes (e.g., reaction processes, filtration processes, precipitation processes, settling processes, etc.) to produce lighter hydrocarbons and/or other commercially useful products. In further embodiments, at least a portion of the removed aqueous material may be subjected to the aqueous phase recycle process 108 to assist in the production of an additional stabilized emulsion. For example, as shown in FIG. 1, at least some of the removed aqueous material, including at least some of the solid particles, may be combined with additional mined material and additional colloidal dispersion to form the additional stabilized emulsion. The additional stabilized emulsion may then be further processed (e.g., destabilized and/or recycled) in a manner substantially similar to that previously described with respect to processing the stabilized emulsion.

The methods of the disclosure advantageously facilitate the efficient removal of hydrocarbon material, such as bitumen, from a mined, hydrocarbon-containing material. The methods of the disclosure may utilize fewer processing acts and fewer materials (e.g., chemical reactants, sparged air, etc.) as compared to conventional extraction processes. Furthermore, the methods of the disclosure substantially reduce the amount of solid materials (e.g., mineral solids, such as coal particles, sand particles, rock particles, silt particles, clay particles, etc.) of the mined material that become and remain suspended in a fluid, substantially reducing difficulties and expenses related to tailings treatment and disposal as compared to conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A method of obtaining a hydrocarbon material from a mined material, comprising:

forming a colloidal dispersion consisting essentially of solid particles and a carrier fluid, the solid particles comprising one or more of alumina, titania, ceria, zirconia, germania, magnesia, an iron oxide, zinc oxide, a silicon carbide, and silicon nitride;

mixing the colloidal dispersion with a mined, hydrocarbon-containing material to form an emulsion stabilized by the solid particles; and modifying at least one property of the emulsion to destabilize the emulsion.

2. The method of claim 1, wherein forming a colloidal dispersion comprises:

selecting the solid particles to comprise one or more of alumina, titania, ceria, zirconia, germania, magnesia, an iron oxide, zinc oxide, a silicon carbide, and silicon nitride; and providing the solid particles into the carrier fluid.

3. The method of claim 1, wherein forming a colloidal dispersion comprises selecting the solid particles to exhibit an average particle diameter of within a range of from about 1 nm to about 100 nm.

4. The method of claim 1, wherein forming a colloidal dispersion comprises selecting each of the solid particles to independently exhibit a spherical shape, a hexahedral shape, an ellipsoidal shape, a cylindrical shape, a conical shape, or an irregular shape.

5. The method of claim 1, further comprising:

combining a portion of the emulsion with additional mined, hydrocarbon-containing material prior to destabilizing the emulsion to form an additional emulsion exhibiting a greater amount of hydrocarbon material than the emulsion; and modifying at least one property of the additional emulsion to destabilize the additional emulsion.

6. The method of claim 1, wherein forming a colloidal dispersion comprises forming the solid particles to exhibit at least one of hydrophilic functionalities, amphiphilic functionalities, oxophilic functionalities, lipophilic functionalities, and oleophilic functionalities.

7. The method of claim 1, wherein forming a colloidal dispersion comprises forming the carrier fluid to comprise an aqueous material.

8. The method of claim 1, wherein forming a colloidal dispersion comprises forming the colloidal dispersion to comprise greater than or equal to about 0.1 percent by weight of the solid particles.

9. The method of claim 1, wherein mixing the colloidal dispersion with a mined, hydrocarbon-containing material comprises mixing the colloidal dispersion with at least one of tar sand, oil sand, bituminous sand, black shale, a coal formation, and a weathered hydrocarbon formation contained in at least one of sandstone and carbonate.

10. The method of claim 1, wherein mixing the colloidal dispersion with a mined, hydrocarbon-containing material to form an emulsion stabilized by the solid particles comprises forming the emulsion to comprise a hydrocarbon material dispersed within an aqueous material.

11. The method of claim 1, wherein modifying at least one property of the emulsion comprises at least one of decreasing the pH of the emulsion, adding a demulsifying agent to the emulsion, and decreasing the temperature of the emulsion.

12. A method of obtaining a hydrocarbon material from a mined material, comprising:

forming nanoparticles comprising at least one of a metal oxide, a carbide, and a nitride;

combining the nanoparticles with an aqueous material to form a colloidal dispersion;

mixing the colloidal dispersion with a mined material containing a hydrocarbon material to separate the hydrocarbon material from other components of the mined material and form an emulsion stabilized by the nanoparticles; and modifying at least one of a pH, a material composition, and a temperature of the emulsion to destabilize the emulation and coalesce the hydrocarbon material.

13. The method of claim 12, wherein forming the nanoparticles comprises selecting the nanoparticles to consist of alumina.

14. The method of claim 12, wherein forming the nanoparticles comprises forming the nanoparticles to comprise composite particles.

15. The method of claim 12, wherein combining nanoparticles with an aqueous material comprises combining the nanoparticles with an aqueous alkaline solution.

16. The method of claim 12, wherein mixing the colloidal dispersion with a mined material containing a hydrocarbon material comprises mixing the colloidal dispersion with a bitumen-containing material.

17. The method of claim 12, wherein mixing the colloidal dispersion with a mined material comprises selecting the mined material to comprise oil-wetted grains of solid material.

18. The method of claim 12, wherein mixing the colloidal dispersion with a mined material comprises selecting the mined material to comprise water-wetted grains of solid material.

19. A stabilized emulsion comprising:

a dispersed phase comprising bitumen;

a continuous phase comprising an aqueous material; and nanoparticles gathered at interfaces of the dispersed phase and the continuous phase, the nanoparticles comprising one or more of a metal oxide, a carbide, and a nitride.

* * * * *